US006612576B1

(12) United States Patent
Stancik et al.

(10) Patent No.: US 6,612,576 B1
(45) Date of Patent: Sep. 2, 2003

(54) SEAL CARD GAME WITH MULTIPLE LEVELS OF PLAY

(75) Inventors: Robert G. Stancik, Chagrin Falls, OH (US); Daniel C. Birch, Plymouth, MA (US)

(73) Assignee: Arrow International, Inc., Cleveland, OH (US)

( * ) Notice: Subject to any disclaimer, the term of this patent is extended or adjusted under 35 U.S.C. 154(b) by 0 days.

(21) Appl. No.: 10/036,654

(22) Filed: Nov. 7, 2001

(51) Int. Cl.[7] ..... A63F 3/06

(52) U.S. Cl. ..... 273/139; 273/138.1; 283/901; 283/903

(58) Field of Search ..... 273/139, 138.1, 273/269; 283/901, 903

(56) References Cited

U.S. PATENT DOCUMENTS 5,046,737 A 9/1991 Fienberg ..... 273/139
5,407,200 A 4/1995 Zalabak ..... 273/139
5,671,921 A * 9/1997 Quinlan ..... 273/139
5,743,524 A * 4/1998 Nannicola ..... 273/139

OTHER PUBLICATIONS

Arrow International, Inc., "Seal Card Catalog", vol. 1, 2002, Front and back cover pages and pp. 3–5, 8–15 and 18.
Nannicola Incorporated, "Jar Tickets·Seal Cards·Pull Tabs", Front and back cover and p. 10.

* cited by examiner

*Primary Examiner*—Benjamin H. Layno
(74) *Attorney, Agent, or Firm*—Fay, Sharpe, Fagan, Minnich & McKee, LLP

(57) ABSTRACT

A "lottery-type" game of chance for a plurality of players employs break open tickets (10), at least some of the tickets having printed on them one or more instant win awards (40). The awards are covered, prior to play, with one or more removable cover members (34) such as flaps or scratch off seals. Some of the tickets include one or more eligible game symbols (52) which entitle the ticket holder to enter a bonus round of play.

29 Claims, 4 Drawing Sheets

SEAL CARD GAME WITH MULTIPLE LEVELS OF PLAY

BACKGROUND OF THE INVENTION

The present invention relates to gaming systems and, more particularly, to a lottery-type gaming system.

Lottery-type games of chance have exhibited enduring popularity since such games typically permit a player to make a relatively small investment—by buying a ticket—with a chance of winning a significantly larger award. In addition to the entertainment value that such games provide for the players, these types of games typically provide a source of revenue for the operator, normally a charity, but sometimes a municipality or a business establishment.

One type of game system which has proven quite popular with players is the so-called break-open ticket game. In this type of game, players purchase playing cards for a relatively nominal sum, with each playing card displaying game symbols, selected ones of which correspond to award values. In a typical configuration, each playing card comprises a lamination of upper and lower plies of material, such as paper, with the game symbols displayed on the inside surface of the lower ply. The game symbols are thus initially sealed, and are revealed by "breaking open" one or more flap-like portions of the upper ply.

As will be appreciated, affording players an opportunity to win awards in different ways enhances the entertainment value of the game. It has, therefore, been considered desirable to develop a new and improved seal card game and method for playing same which would meet the above stated needs and others and provide advantageous overall results.

SUMMARY OF THE INVENTION

In accordance with one aspect of the present invention, a system for use in playing a game of chance is provided. The system includes a plurality of playing cards, each of the playing cards including game symbols displayed thereon. At least one of the playing cards displays winning game symbols. A master game card is provided for use in conjunction with the plurality of playing cards. The master game card includes a plurality of playing areas representing a plurality of playing levels. The plurality of playing areas includes a first playing area representing a first playing level and at least one successive playing area representing an additional playing level. Each of the playing areas including indicia having at least one award identifier for identifying an award and at least one winning game symbol associated with the identified award. The first playing area includes indicia having at least two award identifiers collectively having at least two different winning game symbols. Each of the successive playing areas includes indicia having at least one award identifier which includes a winning game symbol of a type not present in any of the previous playing areas.

In accordance with another aspect of the present invention, a system for playing a game of chance is provided. The system includes a plurality of playing cards, each of the playing cards including game symbols displayed thereon. At least one of the playing cards displays at least two different winning game symbols. A master game card is provided for use in conjunction with the plurality of playing cards. The master game card includes a plurality of playing levels, including a first playing area representing a first playing level and at least one successive playing area representing an additional playing level. Each playing area includes an award symbol and a winning game symbol associated with the award symbol. The first playing area includes at least two different winning game symbols. Each winning game symbol is only displayed once in the plurality of playing areas on said master game card.

In accordance with another aspect of the present invention, a lottery-type game system provides multiple levels of play. The system includes a plurality of playing cards, each of which can be purchased by game players for a predetermined price per playing card. Each of the playing cards has a plurality of groups of game symbols displayed thereon, with each of the cards including selectively removable means for concealing groups of game symbols thereon prior to purchase by a player. The means for concealing the game symbols is removed by the player after purchase for providing a first level of play. A master game card is provided for use in conjunction with the playing cards, the master game card includes a plurality of playing areas representing at least second and third levels of play. Each playing area includes an award symbol and a winning group of game symbols associated with the award symbol. The second level of play includes at least two playing areas, each playing area having a different winning group of game symbols. The third level of play comprises at least one playing area, each playing area at said third level having a different winning group of game symbols from each other group of game symbols at the third level of play and each group of game symbols at the second level of play.

In accordance with another aspect of the present invention, a method for playing a game of chance is provided. The method includes distributing a set of tickets among a plurality of players. At least one cover member on each of the tickets is removed to reveal a plurality of groups of game symbols. A plurality of groups of winning game symbols in a first playing area separate from the tickets are uncovered and at least one of the groups of game symbols on each ticket is compared with the groups of winning game symbols in the first playing area. A plurality of groups of winning game symbols in a second playing area separate from the tickets and the first playing area is uncovered at least one of the groups of game symbols on each ticket compared with at least one group of winning game symbols in the second playing area. The groups of winning game symbols in the first playing area are different from each of the groups of winning game symbols in the second playing area. First and second awards are both awarded to the holder of a ticket displaying one of the groups of winning game symbols in the first playing area and one of the groups of winning game symbols in the second playing area. The first award is associated with the group of winning game symbols in the first playing area. The second award is associated with the group of winning game symbols in the second playing area.

The advantages of the present invention will become apparent to those skilled in the art upon a reading and understanding of the following detailed specification.

BRIEF DESCRIPTION OF THE DRAWINGS

The invention may take physical form in certain parts and arrangement of parts, preferred embodiments of which will be described in detail in this specification and illustrated in the accompanying drawings which form a part hereof and wherein.

DETAILED DESCRIPTION OF THE PREFERRED EMBODIMENTS

Figure 2:
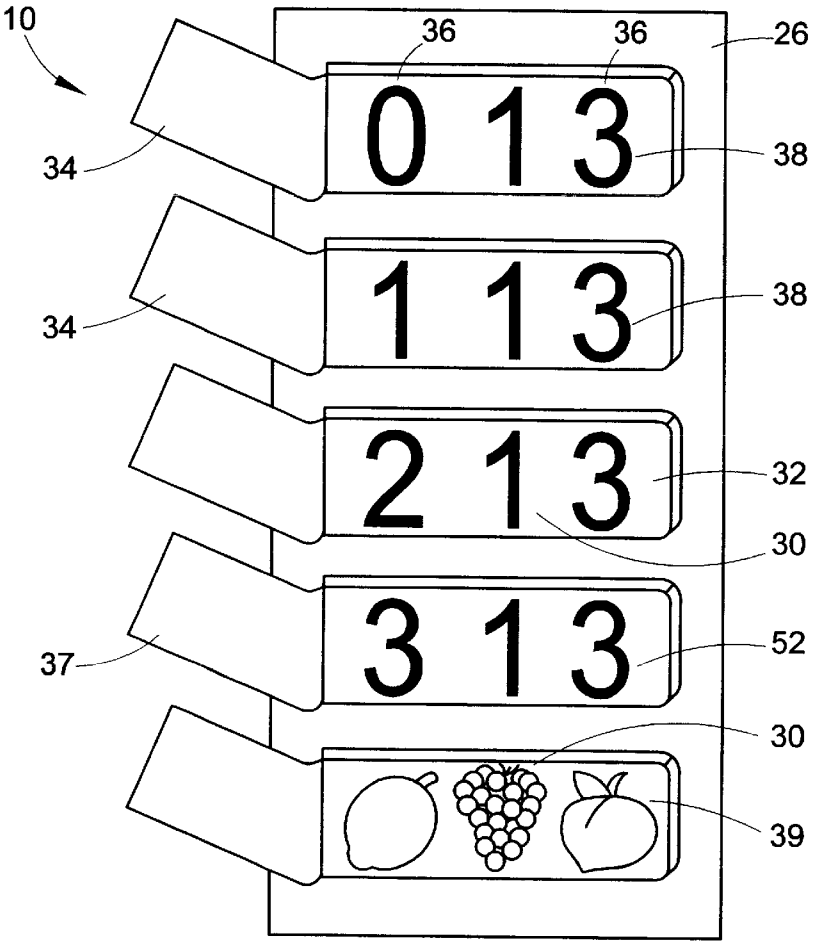
FIG. 2 is a top perspective view of a rear face of the playing card of FIG. 1 with four flaps opened.

While this invention is susceptible of embodiment in many different forms, there is shown in the drawings and will herein be described in detail, several preferred embodiments of the invention. However, it should be understood that the Figures are to be considered only as exemplifying the principles of the invention and are not intended to limit the invention to the embodiment illustrated.

Figure 1:
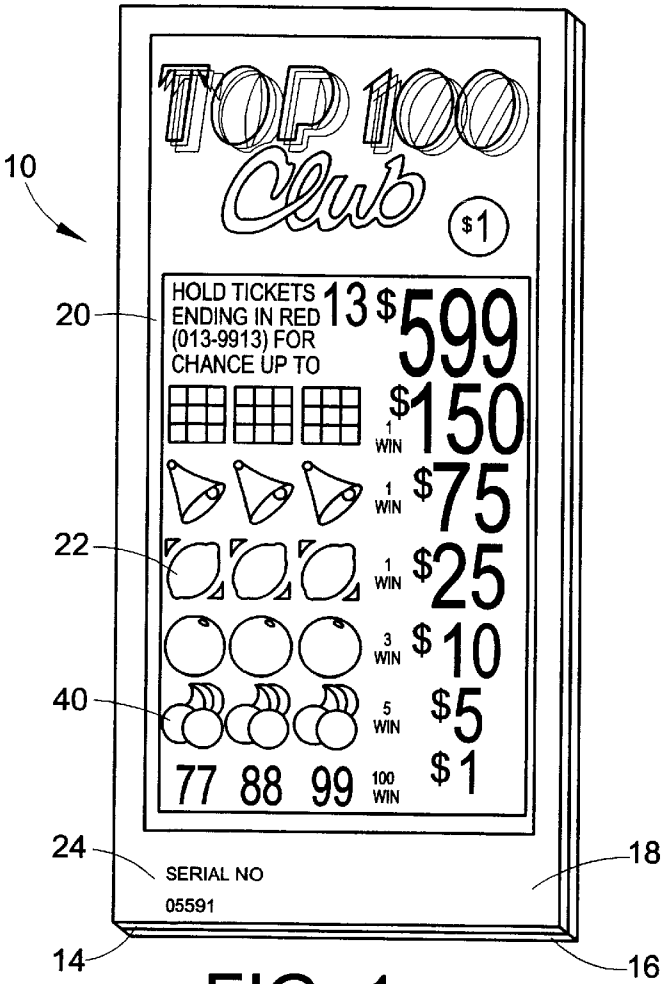
FIG. 1 is a top plan view of a front face of a playing card for a five level game system according to the present invention.
Figure 3:
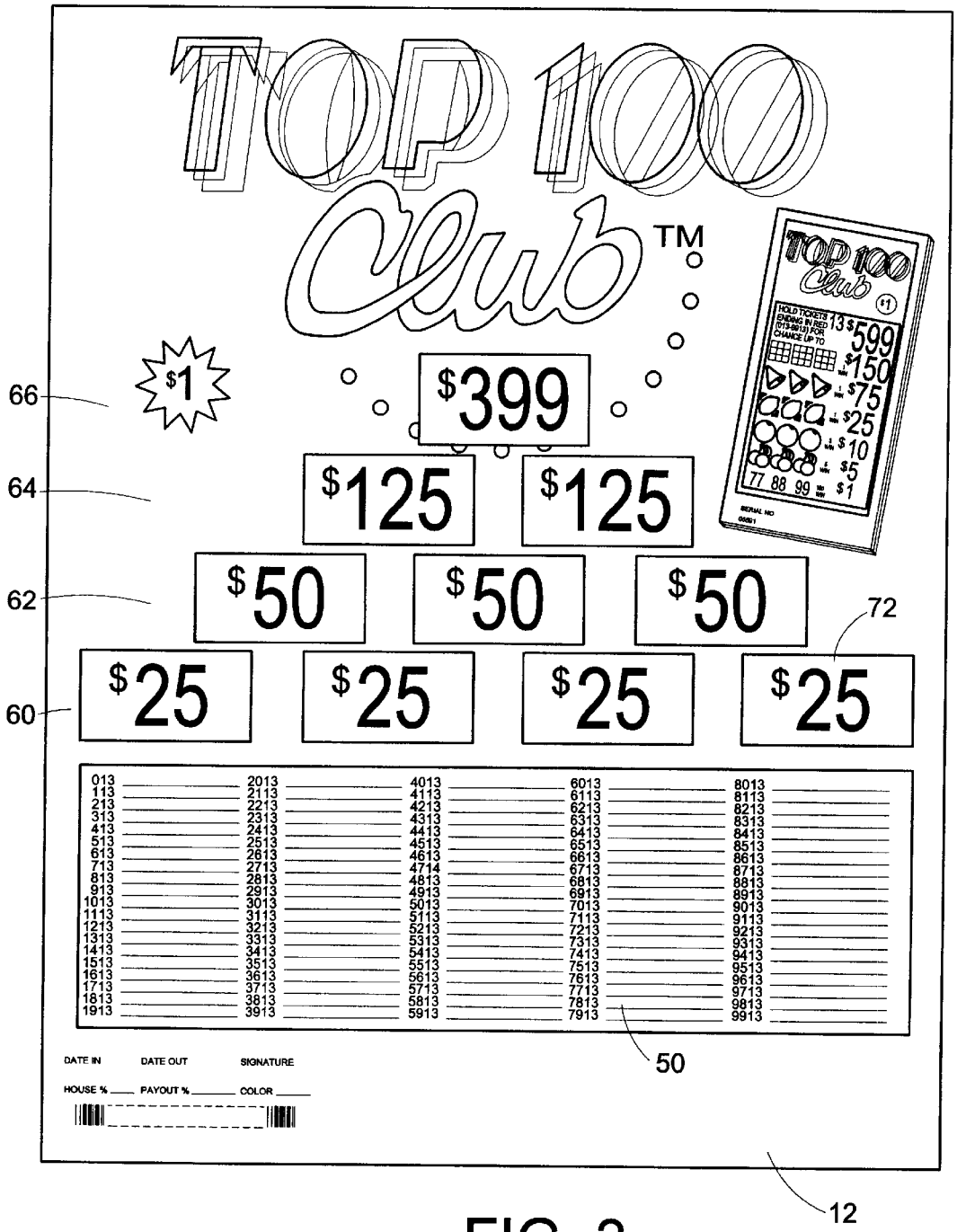
FIG. 3 is a top plan view of a master game card of the four level game system according to the present invention.
Figure 4:
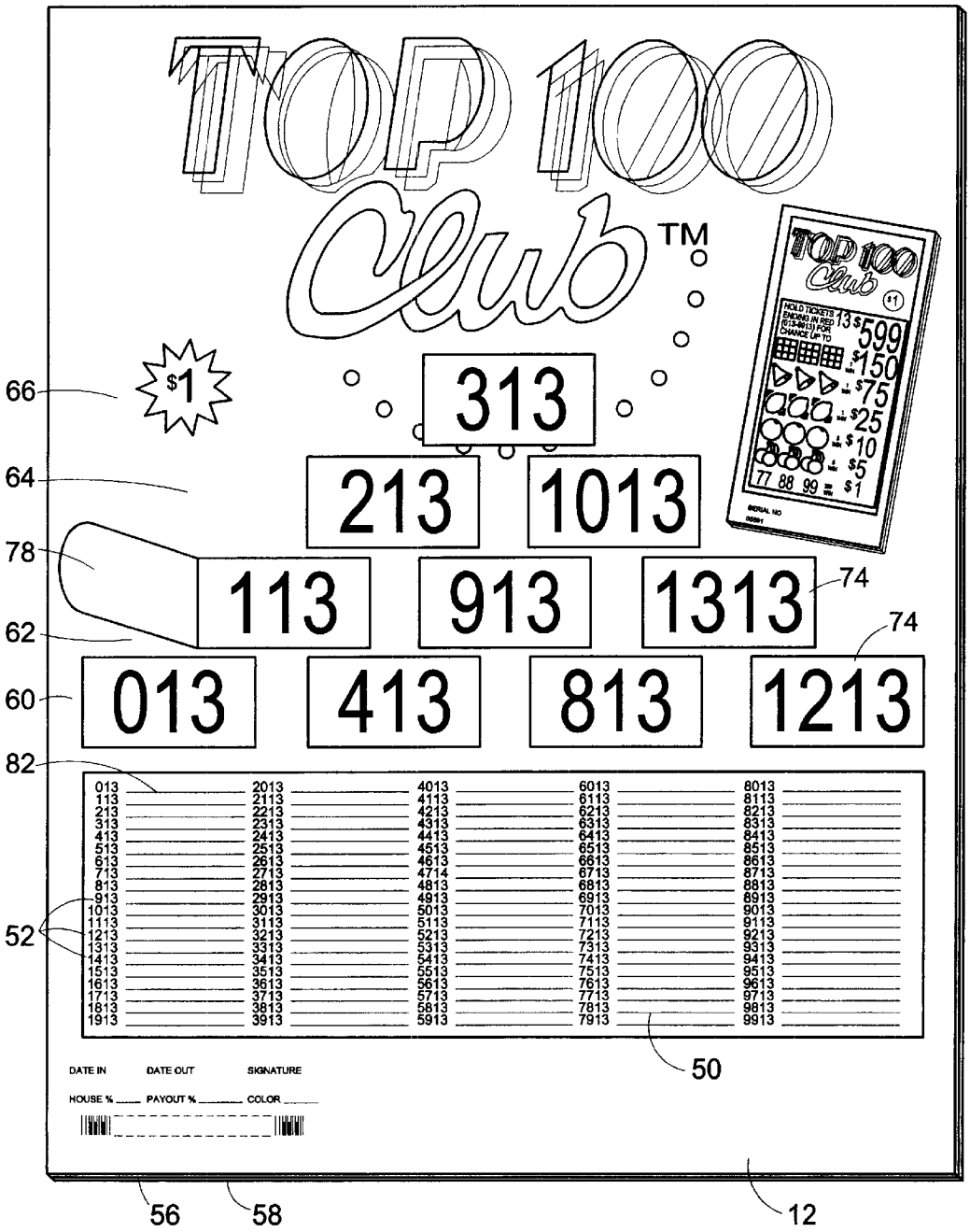
FIG. 4 is a top plan view of the master game card of FIG. 3 with the flaps open to reveal the winning symbols for each tier of play.

FIGS. 1 and 2 illustrate a playing card or ticket 10 and FIGS. 3 and 4 illustrate a master game card 12 which are used in combination for playing a game of chance, namely a five level game system according to the present invention. While the game is described with reference to a first "instant win" level of play followed by four bonus tiers or levels of play, it will be appreciated that the instant win level may be eliminated and fewer or more bonus levels of play may be used, for example, two, three, or five bonus levels of play.

Playing card 10 is intended as exemplary, in that the present game system includes a substantial number of such playing cards. In a preferred embodiment, for example, about 2,000 cards are employed. Each of the playing cards is purchased by a game player for a nominal sum, such as $1.00. Certain ones of the players are eligible to participate in the selection of a bonus award on the master game card 12. The playing cards 10 are preferably packaged as a set, in a clear wrapping, together with the master game card 12.

As shown in FIG. 1, each of the playing cards 10 preferably comprises upper and lower layers or plies of material 14 and 16, laminated together at the edges of their inner or facing surfaces, and formed from paper, card, or the like. An outer, first face 18 of one of the plies 14 may be used to display information about the game, such as the rules of the game 20, examples of winning combinations 22 of symbols, and the like (see FIG. 1). The price of each playing card ($1.00 in the illustrated embodiment) is also printed on the first face or elsewhere on the playing card. Alternatively, the first face may be left blank. An identifying character, such as a serial number 24 is printed on the front face 18 (or back face 26) for identifying the playing card as being part of the set of playing cards all with the same serial number and associated with a corresponding serial number printed on the master game card 12.

With particular reference to FIG. 2, each of the playing cards displays a plurality of game symbols 30. The symbols may be letters, numbers, characters, such as dollar signs, bells, and the like commonly associated with lottery games. Each of the cards includes a plurality of cover members, a single cover member, or other game symbol concealing means. Preferably, the symbols are displayed on the inside surface 32 of the upper ply 14 of the card. This type of card is typically referred to as a "break-open" playing card, in that the cover member comprises one or more flap-like portions 34 of the lower ply 16 (five flaps 34 are shown in FIG. 2) which cover groups 36 of game symbols 30. The flaps 34 can be selectively removed from each of groups 36 of game symbols in order to reveal the respective group of game symbols after the card has been purchased. The flaps have perforated edges 37, allowing them to be readily separated from the surrounding upper ply material. However, it will be understood that a game embodying the principles of the present invention may include playing cards and a master game card otherwise configured, such as including "scratch-off" arrangements for initially concealing game symbols or groups of game symbols.

The game preferably has three or more levels of play, each succeeding level generally involving fewer of the game players (of course, one player may have purchased more than one card for a greater chance of winning). In its first, "instant win" level of play, the present game system provides awards to those players having cards which display a predetermined winning symbol or group of award symbols 38. Preferably, at least one group 39 from the groups of symbols 36 is of an "instant-win" variety. To assist players in ascertaining winning cards at the first level of play, a listing 22 of winning groups of award symbols is provided on the front face of each playing card and/or the master game card. The playing card holder compares the group of symbols 39 with the different groups of award symbols to determine whether the playing card is a winning playing card. An instant-win game player takes the winning playing card to a game organizer and receives the winning amount accorded to the particular winning symbol or group of symbols 40 (FIG. 1).

In its additional, bonus levels of play, the present system permits selected ones of the players to become eligible for several bonus awards through use of the master game card 12.

The first bonus level of play of the present game system entails establishing selected game players who become eligible for the bonus awards, with these players then listed on the master game card 12 in the illustrated embodiment. To this end, the master game card 12 includes a sign up area 50, for listing the selected, eligible players (FIG. 3). In the illustrated embodiment, the eligibility of these selected players is established by those players having cards having predetermined selected ones of the game symbols. In the illustrated embodiment, such predetermined eligible game symbols comprise numeric designations ending in a red 13 (i.e., 013, 113, 213, etc.). Each of the eligible game symbols 52 is printed on one of the game cards (see FIG. 4). On opening a flap to reveal an eligible game symbol or group of game symbols 52 (both will be referred to hereinafter simply as eligible symbols), the game player preferably enters his name on the sign up area in the appropriate location (e.g., adjacent his eligible symbol). In the illustrated embodiment, the one hundred eligible symbols 52 on the sign up area 50 comprise the "100 club."

As shown in FIG. 4, the master game card 12 preferably comprises a lamination of upper and lower plies of material 56 and 58. The master game card 12 further includes an arrangement whereby selected ones of the listed, eligible players are identified as winners in several tiers of bonus round play.

The master game card 12 is shown in FIGS. 3 and 4 as including a plurality of playing levels or tiers. In the illustrated embodiment, the master game card 12 includes four bonus round playing levels: a first playing level 60, a second playing level 62, a third playing level 64, and a fourth playing level 66. At least one award identifier 70 is associated with each playing level (FIG. 3). Each award identifier 70 identifies an award 72. At least one winning game symbol 74 is associated with each award (FIG. 4). In the illustrated embodiment, the winning game symbols are printed on an upper surface 76 of the lower ply. The winning game symbols are covered by cover members 78, such as perforated flaps similar to those on the playing cards 10, or other covering member. The flaps 78 are formed in the top ply 56 and are pulled away to reveal the winning game symbols 74. The awards 72 for each level, such as a monetary amount, are printed on a top surface of each of the flaps, as shown in FIG. 3, or elsewhere on the master game card or playing cards.

By way of example, in the first bonus round tier, there are four unique winning game symbols 74 having the numeric designations: "013", "413", "813", and "1213", as shown in FIG. 4. Each successive playing level can contain one fewer winning game symbol than its respective immediately previous playing level, such that in the fourth (or final) level of play, there is only one winner. Thus a building block or stacking-like game configuration can be provided. The winning game symbols for the second round and subsequent rounds can be different from each other and from the first round game symbols so that no winning game symbol is repeated on the master game card.

Each of the playing cards can have more than one group 36 of bonus round symbols. For example, in FIG. 2, the playing card has one group of bonus round symbols for each level of bonus round play (four in the illustrated embodiment). Each of the eligible symbols 52 can be associated with only one of the playing cards in the set of playing cards. Thus, only one playing card will have the eligible symbol 113, and so forth.

In one embodiment, a playing card holder who is eligible for entry into a first level of bonus round play automatically is eligible for entry into all of the remaining levels of bonus round play. For example, a playing card may have the following eligible symbols 52: 013, 113, 213, and 313, with the winning symbols in the first bonus level being selected from a group which includes 013; in the second level, from a group which includes 113; in the third level, from a group which includes 213; and in the fourth level, from a group which includes 313. Thus, if there are 100 eligible symbols 52 for the bonus levels, these will be distributed over 25 of the playing cards. The eligible symbols may be arranged sequentially on each playing card of the eligible playing cards, (e.g., in order, top to bottom) so that for example, the first symbol corresponds to the first level of bonus round play, and so forth. Or the eligible symbols may be randomly arranged, so that the player does not know in advance which group may be eligible for which round.

In this embodiment, an "elimination" system sequentially eliminates one of the eligible players. As shown in FIG. 4, in the first level, four of the playing cards 10 have winning symbols. Of these four playing cards, only three will have winning symbols corresponding to those in the second level. Of these three playing cards, only two will have winning symbols corresponding to those in the third level. Of these two playing cards, only one will have a winning symbol corresponding to that of the fourth level.

Figure 5:
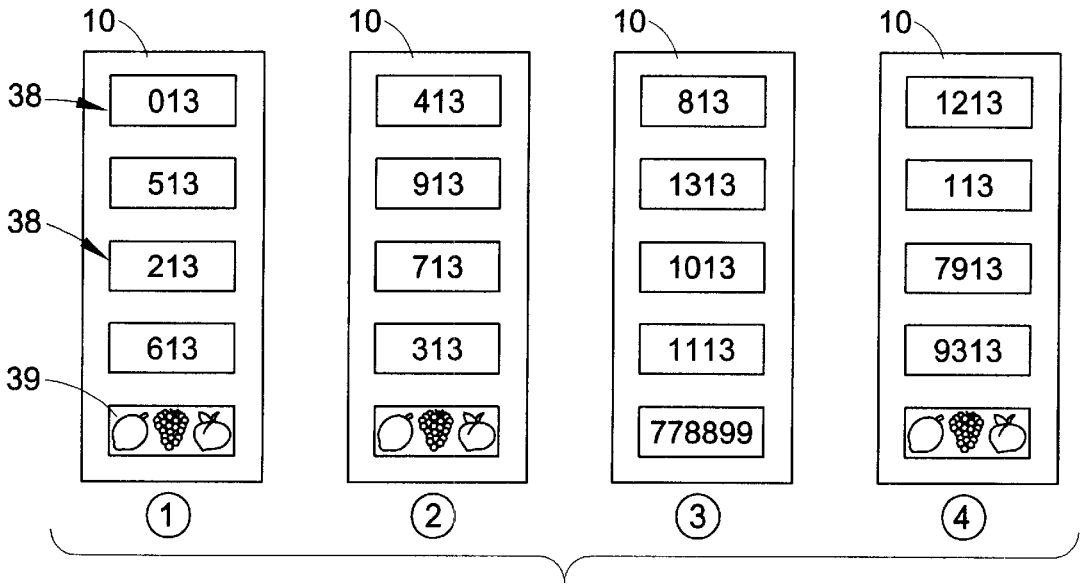
FIG. 5 is a schematic view of four exemplary playing cards with the flaps removed to reveal game symbols according to the present invention.

In a slightly different embodiment, a playing card that has been eliminated in a lower level may be a winner in a higher level. For example, in the embodiment of FIG. 5, when played with the master game card shown in FIG. 4, playing card 1 wins at the first and third levels, playing card 2 wins at the first, second, and fourth levels, playing card 3 wins at the first, second, and third levels, and playing card 4 wins at the first and second levels.

Figure 6:
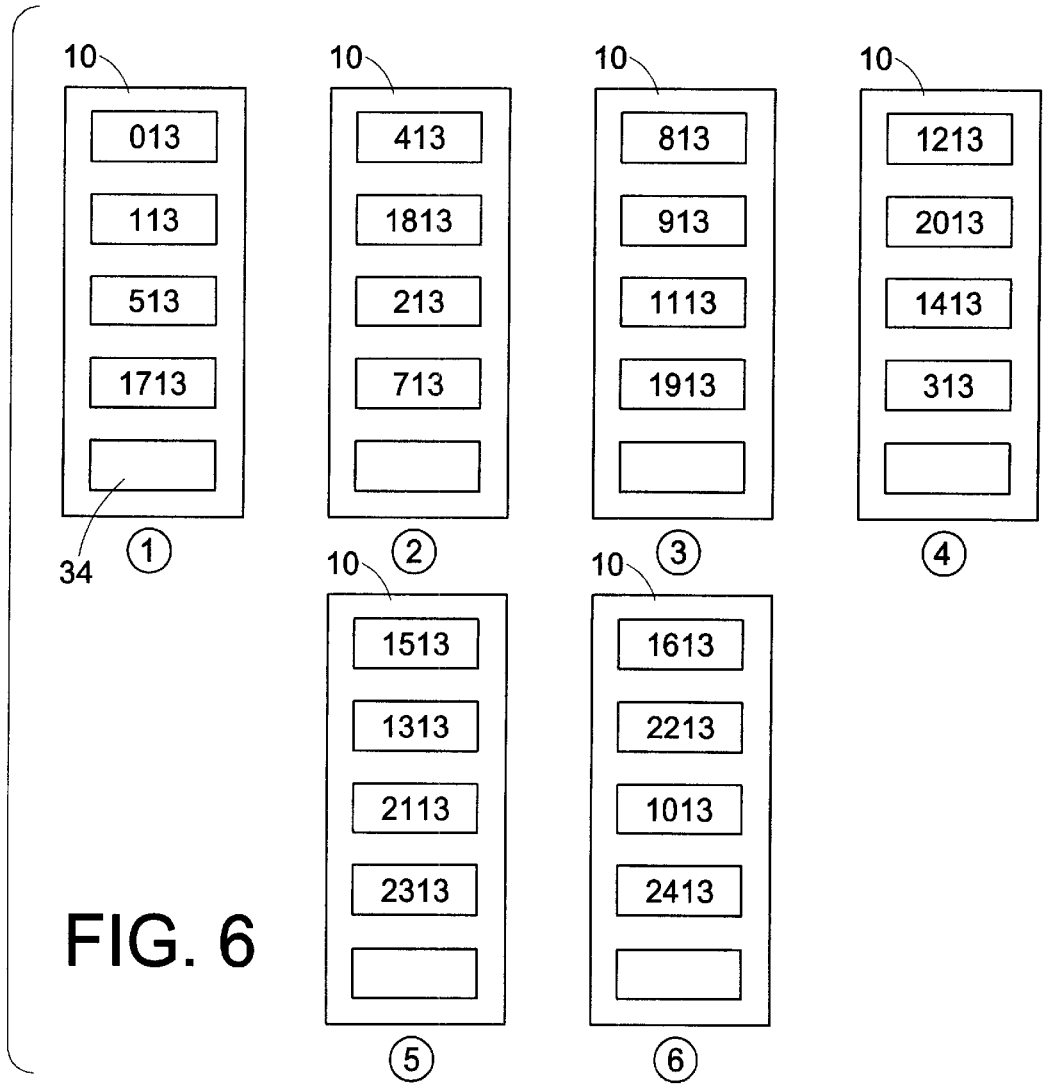
FIG. 6 is a schematic view of six exemplary playing cards, each with four of the flaps removed, according to the present invention.

In another embodiment, more than four playing cards are winning playing cards in the bonus levels. For example, four of the playing cards may be winners in the first level. None, one or more of these playing cards may be winners in the second level with the remaining winners being selected from other eligible playing cards. In the third round, none, one, or more of the winners may be selected from first or second level winners, with the remaining winners being selected from other eligible playing cards, and so forth. For example, in the embodiment illustrated in FIG. 6, playing cards 1, 2, 3, and 4 are first level winners, playing cards 1, 3, and 5 are second level winners, playing cards 2 and 6 are third level winners, and playing card 4 is the fourth level winner. Such a method of play maintains the excitement for those eligible players who were not first round winners. However, the total prize that a single player may win is generally less than with an elimination method.

In the illustrated embodiment, the awards 72 within any playing level are equal to one another. Moreover, the awards 72 associated with the winning game symbols of a respective playing level increase as the level of play increases. Winning game symbols present within first playing level 60 are each associated with a $25.00 award; winning game symbols present within second playing level 62 are each associated with a $50.00 award; winning game symbols present within third playing level 64 are each associated with a $125.00 award; and the winning game symbol present in fourth playing level 66 is associated with a $399.00 award.

The holder of a winning playing card receives the aggregate of the awards 72 associated with each playing level in which the winning game symbols present on that playing card appear. For example, in the embodiment of FIG. 1, the playing card showing winning symbol having the numeric designation "013" is a winner within the first playing level 60. The holder of the playing card displaying winning game symbol "013" thus receives a $25.00 award. Since the ticket also has game symbols "113, " "213," and "313," which are winning game symbols in the second, third, and fourth levels, the holder of the playing card 10 of FIG. 1 receives $599.00: the aggregate of $25.00, $50.00, $125.00, and $399.00.

Initially, all the flaps 78 on the master game card are in a closed position, covering the associated winning game symbols, as shown in FIG. 3. Once the playing cards 10 have been distributed, each of the flaps 78 is opened in order to reveal game symbols displayed beneath. Although, in the illustrated embodiment, winning game symbol concealment is achieved through the use of a 2-ply master game card construction, the winning game symbol cover member or members may have numerous alternative configurations. For example, master game card 12 may comprise only a single ply construction, with the winning game symbol cover member comprising a flap-like member affixed to master game card 12 along one side of the flap-like member. Alternatively, the winning game symbol cover member may comprise a removable opaque substance, such as conventionally known "scratch-off" material. Moreover, although in the illustrated embodiment each of the winning game symbols displayed upon master game card 12 is associated with an individual winning game symbol cover member, it is also contemplated that an individual winning game symbol cover member may be employed to conceal a plurality of game symbols. For example, a single winning game symbol cover member may be employed to initially conceal all of the winning game symbols within a single playing level 60, 62, 64, or 66.

In the illustrated embodiment, the sign-up area 50 contains more game symbol designations than the ten winning game symbols actually displayed upon master game card 12. In particular, 100 game symbols, all ending in the numerals "13", are contained within sign-up area 50 and are thus identified as being eligible game symbols. Associated with each eligible game symbol of sign-up area 50 is a name region 82. Each name region 82 provides space for the recordation of the name, or other indicia, which identifies the holder of a playing card 10 which displays the associated eligible game symbol.

In operation, the plurality of playing cards 10 are distributed to players of the present gaming system, who become holders of the tickets. If the present gaming system is being employed for fundraising purposes, each player will purchase one or more tickets for a predetermined price, $1.00 in the illustrated embodiment. The holders of the tickets remove or open the flaps 34 to reveal the game symbols 30 displayed upon the playing card. Holders of cards displaying instant-winning game symbols 22, such as three bars, three bells, or three fruits, as shown in FIG. 1, receive the corresponding designated awards.

The names of the holders of playing cards displaying eligible winning game symbols, which, in the illustrated embodiment, are game symbols ending in the numeric designation "13" can be recorded within the sign-up area 50. Once all the playing cards are sold and the holders of playing cards displaying eligible game symbols have been identified, the winning game symbol cover members 78 are selectively removed or opened. First, all the flaps 78 within first playing level 60 are raised to reveal winning game symbols 74, which in the illustrated embodiment are "013", "413", "813", and "1213". The holders of game cards displaying any of these winning game symbols each receive a $25.00 award. Next, the flaps 78 of the second playing level 62 are raised to reveal the winning game symbols in that level. Holders of playing cards displaying winning game symbols "113", "913", and "1313" each receive an additional $50.00 award. Next, the flaps 78 of the third playing level 64 are raised to reveal their winning game symbols. The holders of game cards displaying winning game symbols "213" and "1013" each receive an additional $150.00 award. Finally, the flap 78 of fourth playing level 66 is raised to reveal winning game symbol "313", and the holder of the playing card displaying this winning game symbol receives an additional $399.00 award.

The assembled game system can include a set of tickets and a master game card as well as a printed set of instructions for play (not shown). The instructions may include information about the payout, which can be a definite payout, such when the levels described above are played and all of the cards are sold. The profit for the game organizer can also be displayed, based on the total income from the cards and the definite payout, optionally also taking into account the cost to the organizer of the set of cards. In another embodiment, no playing card price is set on the playing card. The game proprietor can thus determine the payout ratio or design its own game.

As will be appreciated, variations of the present system can be made within the purview of the present invention. As noted, the playing cards 10 can be otherwise configured, as can the master game card 12. If desired, more than the disclosed levels of play can be provided. Additionally, plural arrangements can be provided for establishing the eligibility for bonus play of selected players. For example, two listings of eligible players can be provided on the master game card, with two different criteria identified for establishing eligibility. The playing card 10 is exemplary of the present invention in that the present game system includes a plurality of such playing cards such as, for example, 200 cards, 500 cards, or in the illustrated embodiment, about 2000 cards. Each of these playing cards 10 is separately purchased by a game player.

The invention has been described with reference to the preferred embodiments. Obviously, alterations and modifications will occur to others upon a reading and understanding of this specification. It is intended that the invention be construed as including all such modifications and alterations as fall within the scope of the appended claims or the equivalents thereof.

We claim:

1. A system for use in playing a game of chance comprising:

a plurality of playing cards, each of the playing cards including game symbols displayed thereon;

at least one of said playing cards displaying winning game symbols;

a master game card for use in conjunction with the plurality of playing cards, the master game card including a plurality of playing areas representing a plurality of playing levels;

the plurality of playing areas including a first playing area representing a first playing level and at least one successive playing area representing an additional playing level;

each of the playing areas including indicia having at least one award identifier for identifying an award and at least one winning game symbol associated with said identified award;

the first playing area including indicia having at least two award identifiers collectively having at least two different winning game symbols; and, each of the successive playing areas including indicia having at least one award identifier which includes a winning game symbol of a type not present in any of the previous playing areas, wherein said at least one laying card displaying winning game symbols displays a first of the winning game symbols associated with said first playing area in a first location on said playing card and displays a second winning game symbol associated with one of the successive playing areas in a second location on said playing card, spaced from said first location.

2. The system of claim 1, wherein the award identifier further includes a cover member for initially concealing the at least one corresponding winning game symbol.

3. The system of claim 2, wherein the winning game symbol cover member includes a flap.

4. The system of claim 2, wherein the award of the award identifier is positioned on the winning game symbol cover member.

5. The system of claim 1, wherein the playing cards further include a cover member for initially concealing the at least one game symbol displayed thereon.

6. The system of claim 5, wherein the game symbol cover member includes a flap.

7. The system of claim 1, wherein each successive playing area includes indicia having at least one fewer award identifier than the respective immediately previous playing area.

8. The system of claim 7, wherein each successive playing area includes indicia having exactly one fewer award identifier than the respective immediately previous playing area.

9. The system of claim 1, wherein each award identifier of a respective playing area includes a winning game symbol different from the winning game symbols of other award identifiers within the same playing area.

10. The system of claim 1, wherein the plurality of playing areas comprises four playing areas, the four playing areas including said first playing area, a second playing area, a third playing area, and a fourth playing area;

the first playing area including indicia having four award identifiers;

the second playing area including indicia having three award identifiers;

the third playing area including indicia having two award identifiers; and the fourth playing area including indicia having one award identifier.

11. The system of claim 1, wherein all of the awards of all of the award identifiers within any of said plurality of playing areas in a playing level are equal to one another.

12. The system of claim 1, wherein each of the award identifiers within each successive playing area includes an award which is greater in value than any of the awards in any previous playing area.

13. The system of claim 1, wherein at least one of the awards comprises a monetary value.

14. The system of claim 1, wherein the game symbols comprise numeric designations.

15. The system of claim 1, wherein at least one game symbol of at least one playing card comprises indicia identifying the game symbol as being an instant winning game symbol.

16. The system of claim 15, wherein at least one of the playing cards further includes indicia indicating a plurality of classes of winning game symbols, the classes of winning game symbols including a class of instant-winning game symbols and a class of game symbols eligible to be a winning game symbol, the indicia indicating whether an individual game symbol is an instant winning game symbol or is a game symbol eligible to be a winning game symbol.

17. The system of claim 1, further including a sign-up area on the master game card for identifying holders of playing cards which include at least one game symbol eligible to be a winning game symbol.

18. A system for playing a game of chance, comprising:

a plurality of playing cards, each of the playing cards including game symbols displayed thereon, a plurality of said game symbols comprising winning game symbols, a first group of said game symbols corresponding only to a first playing level and a second group of said game symbols, different from said first group, corresponding only to an additional playing level;

at least one of said playing cards displaying at least two of said winning game symbols, a first of said winning game symbols being selected from said first group of winning game symbols and a second of said winning game symbols being selected from said second group of game symbols, said first group of winning game symbols being associated with a first area of said playing card and said second group of said winning game symbols being associated with a second area of said playing card spaced from said first area;

a master game card for use in conjunction with said plurality of playing cards, said master game card including a plurality of playing levels, including a first playing area representing a the first playing level and at least one successive playing area representing an the additional playing level;

wherein each playing area comprises an award symbol and a winning game symbol associated with said award symbol;

wherein said first playing area includes at least two different winning game symbols and wherein each winning game symbol is only displayed once in said plurality of playing areas on said master game card.

19. The system of claim 18, wherein said first playing area includes a first of said at least two winning game symbols displayed on said at least one playing card and said successive playing area includes a second of said at least two winning game symbols displayed on said at least one playing card.

20. The system of claim 19, wherein said master game card includes at least one additional playing area intermediate said first playing area and said at least one successive playing area.

21. The system of claim 20, wherein said at least one playing card lacks all of the winning game symbols displayed in said additional playing area intermediate said first playing area and said at least one successive playing area.

22. The system of claim 18, wherein said at least one playing card has a plurality of winning game symbols, a different one of said at least two winning game symbols being displayed in each of said plurality of playing levels.

23. A lottery-type game system providing multiple levels of play, comprising:

a plurality of playing cards each of which can be purchased by game players for a predetermined price per playing card;

each of said playing cards having a plurality of of game symbols displayed thereon, a first group of said game symbols corresponding only to a first playing level and a second group of said game symbols, different from said first group, corresponding only to an additional playing level, selected ones of said playing cards displaying one of said first group of game symbols in a first location on said playing card, selected ones of said playing cards displaying one of said second group of game symbols in a second location on said playing card, spaced from said first location, with each of said cards including selectively removable means for concealing the game symbols thereon prior to purchase by a player, said means for concealing said game symbols being removed by the player after purchase for providing a first level of play;

a master game card for use in conjunction with said playing cards, said master game card including a plurality of playing areas representing at least second and third levels of play;

wherein each playing area comprises an award symbol and a winning group of game symbols associated with the award symbol;

wherein said second level of play comprises at least two playing areas, each playing area at the second level of play having a different winning of game symbols selected from said first group of game symbols; and wherein said third level of play comprises at least one playing area, each playing area at said third level of play having a winning game symbols selected from said second group of game symbols, different from each other winning group of game symbols at said third level of play and each winning game symbols at said second level of play.

24. The lottery-type game system of claim 23, wherein at least one of said playing cards has a first group of game symbols selected from the groups of winning game symbols in the at least two playing areas in the second level of play and a second group of game symbols selected from the winning groups of game symbols in the at least one playing area in the third level of play.

25. The lottery-type game system of claim 24, wherein said at least one of said playing cards has at least three groups of winning game symbols and said master game card further comprises a fourth level of play.

26. The lottery-type game system of claim 23, wherein at least one of said plurality of playing cards includes a group of symbols which is an instant winner.

27. The lottery-type game system of claim 23, wherein said means for concealing said groups of game symbols includes a flap.

28. A method for playing a game of chance comprising:

distributing a set of tickets to a plurality of players;

removing at least one cover member on each of the tickets to reveal a plurality of game symbols arranged sequentially in spaced relation on the tickets;

uncovering a plurality of winning game symbols in a first playing area separate from the tickets and comparing a first of the game symbols on each ticket with the winning game symbols in the first playing area the first game symbol being located in a first area of the ticket;

uncovering a plurality of winning game symbols in a second playing area separate from the tickets and the first playing area and comparing a game symbols in a second sequential area of each ticket with at least one winning game symbols in the second playing area, the winning game symbols in the first playing area being different from each of the winning game symbols in the second playing area;

awarding at least first and second awards to a holder of a ticket displaying both one of the winning game symbols in the first playing area and one of the winning game symbols in the second playing area, the first award being associated with the winning game symbols in the first playing area, the second award being associated with the group of winning game symbols in the second playing area.

29. The system of claim 1, wherein each of the playing areas is associated with a different group of said winning game symbols and wherein each of the playing cards has sequentially arranged positions which correspond to each of said different groups of winning game symbols, such that where a winning game symbol from a selected one of said group of winning game symbols is present on said playing card, it is displayed in the position associated with that group.

* * * * *